United States Patent [19]

Kashiwabara

[11] 4,450,971

[45] May 29, 1984

[54] FOLDING RACK

[75] Inventor: Mikio Kashiwabara, Tokyo, Japan

[73] Assignee: Messrs. Muse Mannequin Co., Ltd., Tokyo, Japan

[21] Appl. No.: 192,773

[22] Filed: Oct. 1, 1980

[51] Int. Cl.[3] ..... A47F 5/13

[52] U.S. Cl. ..... 211/201; 211/182; 403/119; 403/161

[58] Field of Search ..... 211/195, 182, 203, 196, 211/198, 201, 183, 149, 150; 403/161, 119; 108/112, 113; 248/155.1

[56] References Cited

U.S. PATENT DOCUMENTS

| | | | |
|---|---|---|---|
| 1,260,163 | 3/1918 | Downie | 211/201 |
| 1,351,013 | 8/1920 | Steve | 211/195 X |
| 2,596,250 | 5/1952 | Klingler | 108/113 UR |
| 2,764,460 | 9/1956 | Nelson | 108/113 |
| 3,086,256 | 4/1963 | Schieber | 108/112 |
| 3,101,062 | 8/1963 | Kanzelberger | 108/113 X |
| 3,432,128 | 3/1969 | Elleboudt | 211/195 X |
| 4,261,470 | 4/1981 | Dolan | 211/191 |

FOREIGN PATENT DOCUMENTS

| | | | |
|---|---|---|---|
| 34814 | 7/1925 | Denmark | 403/161 |

*Primary Examiner*—Ramon S. Britts
*Assistant Examiner*—Robert W. Gibson, Jr.
*Attorney, Agent, or Firm*—Mawhinney & Mawhinney & Connors

[57] ABSTRACT

A method of assembling a folding rack is provided which makes horizontal hollow beam members collapsible but not vertical hollow support members. The horizontal hollow beam members are pivotally connected with the support members through connectors. Each support member has vertically spaced projections on each of which connectors on the adjacent beam members are coupled one above the other and pivotally retained thereon as by caulking the head of the projection on the support member, so that the beam members are pivotable substantially 90° about the projection.

10 Claims, 7 Drawing Figures

FOLDING RACK

BACKGROUND OF THE INVENTION

The present invention relates to a method of assembling a folding rack of the type which includes vertical hollow frame members or supports, longitudinally extending horizontal hollow frame members or beams interconnecting adjacent supports and hollow cross members extending between laterally opposite vertical members.

Knockdown racks using hollow frame members or pipes have been employed for various purposes such as for displaying wares in the commercial field. Usually, such knockdown rack is set up by the steps of bringing the frame pipes and pipe joints for connecting them together to a desired place and, there, arranging the pipes vertically and horizontally while interconnecting them with the pipe joints. With this system, however, a desired rack cannot be set up at the spot for display or the like unless the necessary numbers of the individual component parts have been fully prepared before the transportation to the intended spot. A precision is needed in connecting the pipes with the pipe joints and, therefore, reasonably skilled work is indispensable. The assemblage of the rack in situ needs a substantial period of time, but the time available for the assemblage is limited. The only solution to this problem is the employment of a disproportionate number of workers. This also holds true in the case of disassemblage of the rack which must be done within a limited time period as after the ware display. It will thus be seen that a knockdown rack requires excessive costs in its assemblage though convenient in use.

Efforts have heretofore been made to settle the above problems by rendering a rack collapsible in situ without taking them to pieces. One result of such efforts is a folding rack whose vertical pipes are collapsible in one way or another relative to the horizontal pipes. This type of rack lacks reliability, however, partly because the collapsible vertical pipes are poor in mechanical strength to bear loads and partly because the rack as a whole is quite susceptible to shocks and impacts applied transversely thereto. The rack with collapsible vertical members is now in use, therefore, solely as a relatively low rack having only one or two supporting steps, as a relatively small rack or as a rack expected to bear relatively light weights; it is generally understood unsuitable to have a height substantially above 180 cm or to support relatively heavy articles.

SUMMARY OF THE INVENTION

A rack assemblying method according to the present invention comprises the steps of coupling an opening formed through a connector rigid on one of two adjacent horizontal hollow beam members over one of projections which are positioned at vertically spaced locations on one wall of a vertical hollow support member, coupling an opening formed through a second connector rigid on the other horizontal beam member from above the first connector, and retaining the first and second connectors on the projection by suitable means such that the opposite horizontal beam members are pivotable substantially 90° in the opposite directions about the projection.

In accordance with the present invention, a folding rack is set up which has non-collapsible vertical hollow support members and collapsible horizontal hollow beam members pivotally connected with the support members through connectors. Each support member has vertically spaced lugs on each of which connectors on the adjacent beam members are coupled one above the other and pivotally retained thereon as by caulking the head of the lug on the support member.

It is an object of the present invention to eliminate the drawbacks inherent in prior art racks of the collapsible type.

It is another object of the present invention to make a rack readily collapsible by one manual action regardless of the number of its load bearing steps.

It is another object of the present invention to ensure resistivity of a rack to substantial loads and various accidental shocks and impacts and thereby enhance the reliability in use.

It is another object of the present invention to minimize the time and labor necessary for setting up and down a folding rack.

It is another object of the present invention to assemble a light weight, compact folding rack which can be conveniently carried to any desired place.

Other objects, together with the foregoing, are attained in the embodiments described in the following description and illustrated in the accompanying drawings.

DESCRIPTION OF THE PREFERRED EMBODIMENTS

While the rack assembling method according to the present invention is susceptible of numerous physical embodiments, depending on the environment and requirements of use, substantial numbers of the herein shown and described embodiments have been made, tested and used, and all have performed in an eminently satisfactory manner.

Figure 1A:
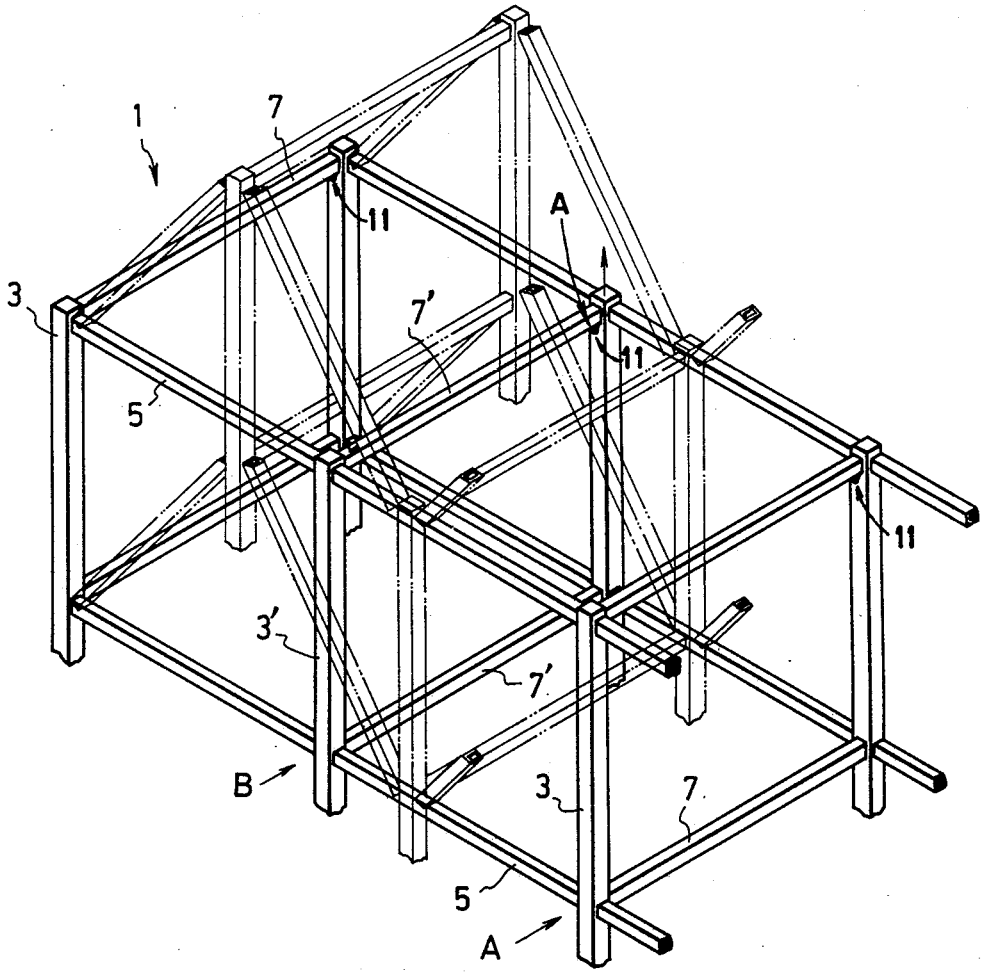
FIG. 1*a* shows in perspective a folding rack put together in accordance with the present invention.
Figure 1B:
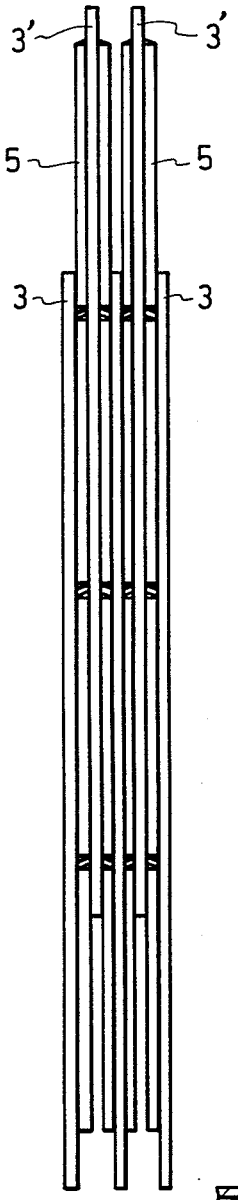
FIG. 1*b* is a front view of the rack brought into its folded position.

Referring now to FIG. 1 of the drawings, there is illustrated a folding rack 1 set up according to the method of the present invention. The rack 1 includes two rows of spaced vertical members or supports 3, horizontal spaced beams longitudinally extending between adjacent supports 3 in the individual rows, and cross beams 7 extending laterally between opposite supports 3. Each of these members 3–7 consists of a determined length of pipe having a rectangular cross-section. With the rack shown, when the beams 5 and cross beams 7 are moved upward, the supports 3' alternating with the posts 3 will also rise as indicated by dash-and-dots lines in FIG. 1*a* until the whole framework collapses to the position shown in FIG. 1*b.*

Figure 2A:
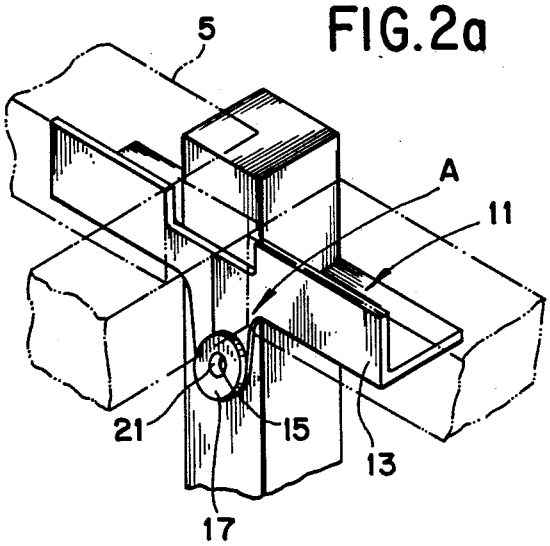
FIG. 5 shows a metal fixture for securing vertical and horizontal members in position relative to each other and FIG. 2*a* is a fragmentary enlarged view of the circled portion A of FIG. 1*a.*
Figure 2:
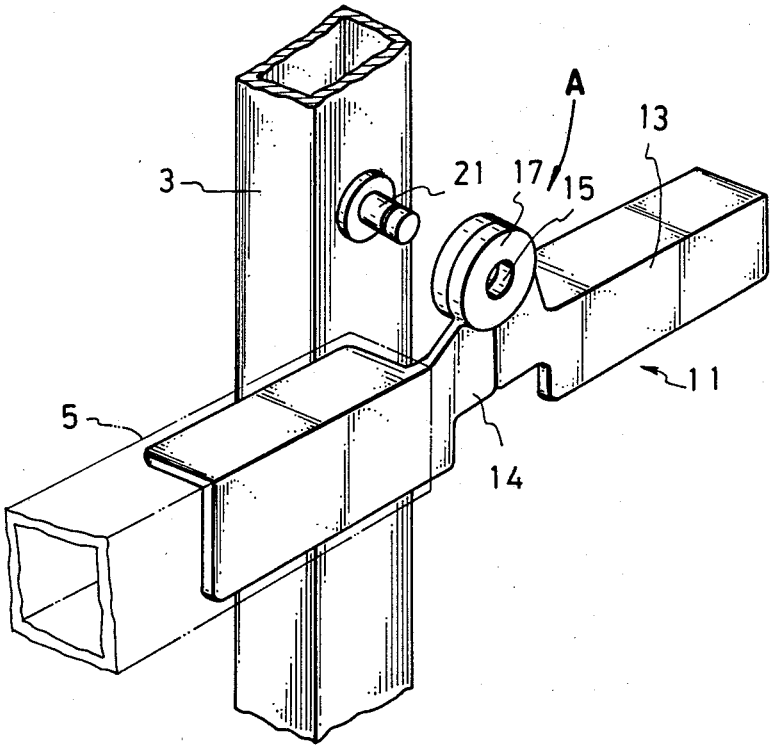
FIG. 2 is a fragmentary enlarged view of a part A of the rack shown in FIG. 1*a;*

To be so collapsible, the framework has the supports 3 and beams 5 interconnected by a mechanism shown in FIGS. 2 and 2*a* which are enlarged views of a part A of the framework of FIG. 1*a*. The mechanism includes a connector 11 whose elongate first or major portion 13 has a generally L-shaped cross-section. The angular connector plates are affixed on the top of a beam member in one place and/or under the longitudinally extending beam members in the opposite way depending on the movement of the beam members when they are folded. This major portion 13 is fixed as by spot welding to the adjacent inner walls of one horizontal beam 5 in the frame part A. An arm-like second portion 14 extends from the vertical wall of the major portion, 13 as seen in FIG. 2 and connects to a generally circular third or coupling portion 17 formed with an opening 15 therethrough. A rivet 21 is studded at a determined position on a wall of the support 3; such rivets 21 are studded in vertically spaced locations along the length of the support 3. The other horizontal beam 5 in the frame part A is provided with a similar connector 11. The connectors 11 on the adjacent beams 5 have the openings in their coupling portions 17 coupled over the rivet 21 one above the other and are pivotally retained thereon as by caulking the head of the rivet 21. While the major section 13 of each connector 11 has been shown and described as having two walls to be connected to two walls of a beam 5, a single wall will suffice if it ensures a sufficient mechanical strength of the member. A single-wall connector will facilitate economical production and minimize the number of portions to be spot welded.

Figure 3:
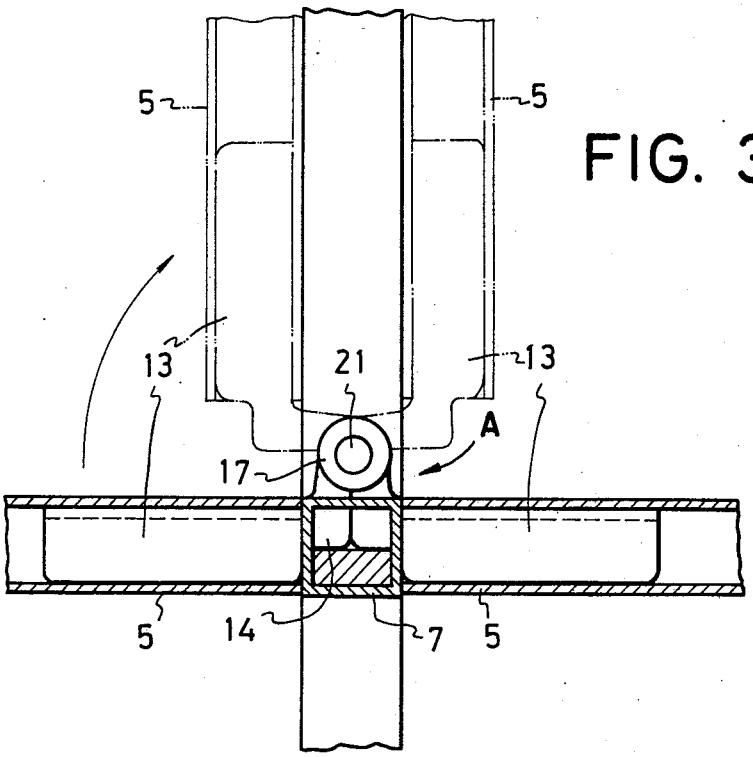
FIG. 3 is a section of the frame part A as seen from the back.

FIG. 3 is a section of the frame part A of FIG. 1*a* as seen from the back. As shown, one of the adjacent connectors 11 has its arm 14 made not flush with the vertical wall of the major portion 13 but somewhat recessed relative thereto such that it can abut against the arm 14 of the other when coupled one upon the other on the rivet 21. The arms 14 have straight abutting ends which ensure their abutment over a large area while the lower end portions are notched to make the connectors 13 pivotable about the rivet 21 in the opposite directions to each other. With this construction, the connectors 11 and their associated beams 5 can swing 90 upward as indicated by an arrow from the illustrated first position until the beams 5 reach a second position where they abut against opposite side walls of the support 3. In a frame part B immediately adjacent to the frame part A, connectors 11 will be fixed to the beams 5 in the opposite relation to the connection in the frame part A so that the beams 5 there can swing downward while raising the associated post 3'.

With the above arrangement, the rack assembly not only facilitates easy folding by one manual action but preserves a sufficient mechanical strength because the vertical supports 3 are in the form of simple continuous pipes different from the conventional collapsible pipes.

Figure 4:
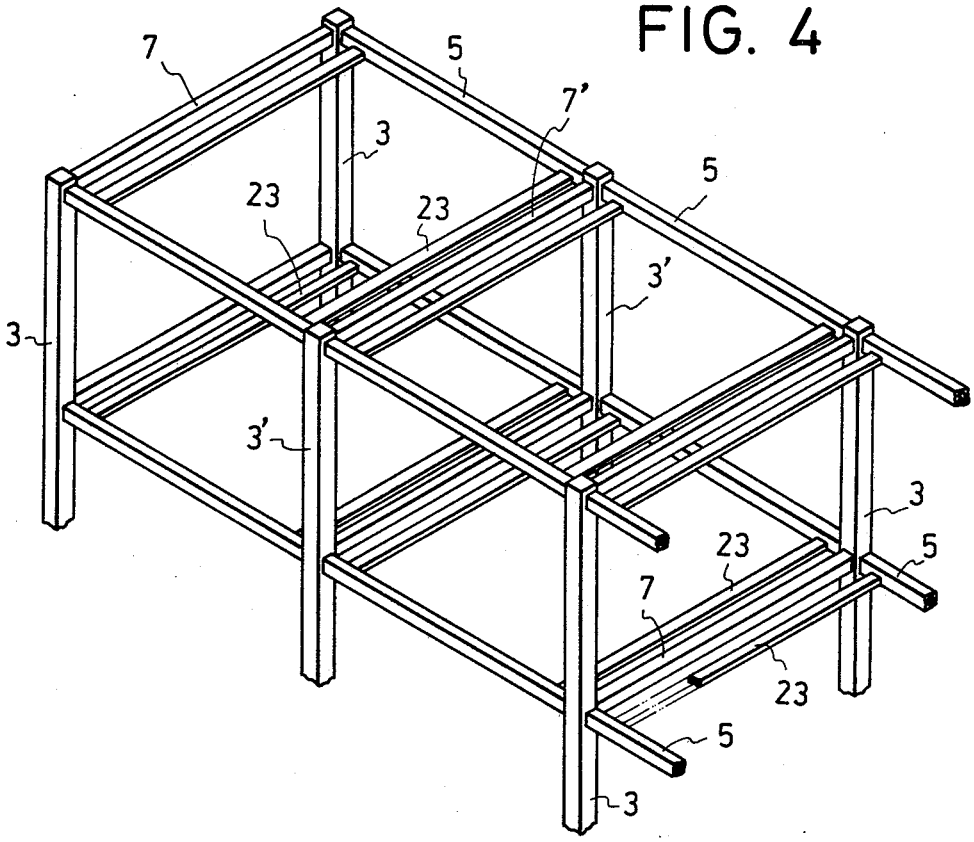
FIG. 4 illustrates another rack arrangement which additionally includes reinforcing cross members.

Another possible construction of the foldable rack is shown in FIG. 4. This rack is substantially similar to the rack discussed above except for the provision of additional horizontal cross beams 23 for reinforcement. As shown, the reinforcing cross beams 23 extend between the norizontal beams 5 in the opposite rows in parallel with the cross beams 7 and have an inverted U-shaped cross-section. With these rainforcing beams 23, the rack will have a sufficient mechanical strength even if made up of pipes of a relatively small inside dismeter which may be desired to make the rack light weight and portable in its collapsed state. The top surfaces of the reinforcing members 23 can also serve to bear a load thereon. Another effect obtainable with the reinforcing members 23 is the avoidance of twisting of the entire framework.

Figure 5:
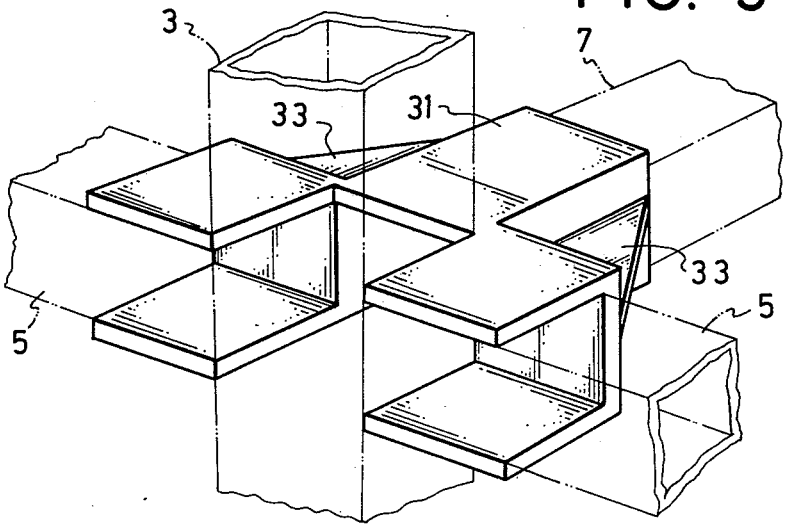

Turning to FIG. 5, there is shown a metal fixture 31 adapted to fix the support norizontal beams and cross beam in place relative to each other and applicable to any one of the rack assemblies described above. This metal fixture 31 is an integral body of a first portion (no numeral) having a generally inverted U-shape cross-section and a second portion (no numeral) which is bifurcated and has a generally inverted C-shaped cross-section as seen in FIG. 5. The fixture 31 is first placed on a cross beam 7 with its first portion straddling the cross beam 7 and then caused to slide therealong until the second portion firmly engages the corresponding vertical member 3 and horizontal members 5 from inside. The rack with the metal fixtures 31 can be effectively safeguarded against sidewise shaking or any other accidental shocks and impacts. The fixture 31 may be formed integrally therewith flat projections 33 which extend inward from its side walls substantially midway along the height to serve as shelves to support loads. It will be apparent that the fixture 31 may have an inverted U-shaped first section and a non-bifurcated one inverted C-shaped second section so as to secure a horizontal pipe 5 or a cross pipe 7 alone to a vertical pipe 3.

In summary, it will be seen that the present invention provides a new method of assembling a folding rack which permits a rack to collapse from its position set for use easily by one manual action regardless of the supporting steps thereof and, due to the non-processed simple straight vertical members, ensures a sufficient durability against loads. With optional provision of reinforcing members and/or metal fixtures, the rack can effectively cope with sidewise shocks and impacts which have been inherently damaging to prior art folding racks.

Various modifications will become possible for those skilled in the art after receiving the teachings of the present disclosure without departing from the scope thereof.

What is claimed is:

1. A folding rack comprising vertical, longitudinally spaceable, support members; longitudinally extending beam members interconnecting adjacent ones of the vertical support members; pivot connection means swingably attaching ends of the beam members to adjacent ones of the vertical support members so that said vertical support members can be moved into close together or longitudinally spaced apart relation; horizontally extending cross beam members interconnecting laterally opposite ones of the vertical support members; bracket means connecting the ends of the cross beam members to the vertical support members; said pivot connection means including a first plate fixed to an end of one beam member adjacent a vertical support member; a second plate fixed to an adjoining end of an adjacent beam member; said plates having axially projecting arms which terminate in vertical longitudinally overlapping free end portions that have transversely aligned apertures; and projections on the vertical support members positioned within the aligned apertures so that the end portions can commonly rotate on the projections whereby the adjoining beam members can swing vertically up and down about the projections to move the vertical support members into collapsed and spaced apart placement for the closed and open positions of the rack.

2. The rack of claim 1 wherein means is provided for anchoring said projections within the apertures.

3. The rack of claim 1 wherein said longitudinally extending beam members are non-circular in cross section and have top and inside faces and said first and second plates are of right angular configuration having a horizontal and a vertical flange fixed on the faces of the beam members.

4. The rack of claim 3 wherein said arms axially project from the vertical flanges.

5. The rack of claim 4 wherein said free end portions on the arm are circular washer-like portions with the projections being rivets.

6. The rack of claim 1 wherein said arms have ends that abut in vertical relation to lock the beams in horizontal longitudinally aligned relation.

7. The rack of claim 1 wherein said bracket means includes a sleeve fixedly telescoped onto an end of a cross beam with a channel member carried by the sleeve at its outer end and in which the longitudinal beam members are fixed, said channel member having a center cut-out to accommodate the vertical support member.

8. The rack of claim 7 wherein said bracket means are of one-piece integral construction.

9. The rack of claim 1 wherein said vertical support member, longitudinal beams and cross beams are hollow.

10. The rack of claim 9 wherein said members and longitudinal beams and cross beams are square pipes.

* * * * *